United States Patent [19]

Schabert

[11] Patent Number: 4,743,182

[45] Date of Patent: May 10, 1988

[54] ROTATING PISTON COMPRESSOR WITH THIN-WALLED RADIALLY-RESILIENT PISTON

[75] Inventor: Hans-Peter Schabert, Erlangen, Fed. Rep. of Germany

[73] Assignee: Kraftwerk Union Aktiengesellschaft, Mülheim/Ruhr, Fed. Rep. of Germany

[21] Appl. No.: 898,696

[22] Filed: Aug. 21, 1986

[30] Foreign Application Priority Data

Aug. 26, 1985 [DE] Fed. Rep. of Germany ..... 3530436

[51] Int. Cl.[4] ..... F04C 18/356; F04C 27/00

[52] U.S. Cl. ..... 418/57; 418/63; 418/142; 418/156

[58] Field of Search ..... 418/56, 57, 63, 142, 418/153, 156, 157

[56] References Cited

U.S. PATENT DOCUMENTS

| | | | |
|---|---|---|---|
| 3,193,192 | 7/1965 | Carter, Jr. | 418/63 |
| 3,767,333 | 10/1973 | Ashikian | 418/56 |
| 3,806,977 | 4/1974 | Anderson | 418/63 |
| 4,139,336 | 2/1979 | Hopkins | 418/142 |

FOREIGN PATENT DOCUMENTS

| | | | |
|---|---|---|---|
| 2832568 | 2/1980 | Fed. Rep. of Germany | 418/153 |
| 3343908 | 6/1984 | Fed. Rep. of Germany . | |
| 370367 | 4/1973 | U.S.S.R. | 418/63 |

*Primary Examiner*—John J. Vrablik

*Attorney, Agent, or Firm*—Herbert L. Lerner; Laurence A. Greenberg

[57] ABSTRACT

A rotating piston compressor includes a cylinder having a first given diameter, a thin-walled, radially-resilient piston with a circular cross section and a second given diameter being disposed in the piston, a radial support for the piston in the form of a rotation-symmetrical thin-walled shell formed of permanently elastic material having one end connected to the piston and another end, a body with a circular periphery holding the other end of the shell, and a drive shaft connected to the body for moving the piston with an eccentricity being larger than one half of the difference between the first and second given diameters.

12 Claims, 5 Drawing Sheets

ROTATING PISTON COMPRESSOR WITH THIN-WALLED RADIALLY-RESILIENT PISTON

The invention relates to a rotating piston compressor, including a cylinder in which a thin-walled, radially-resilient piston with circular cross section is radially supported and is eccentrically movable by a drive shaft, wherein the eccentricity is larger than half the difference between the diameters of the cylinder and the piston.

In a rotating piston compressor of the above-mentioned type which is known from German Published, Non-Prosecuted Application No. DE-OS 33 43 908, the cylindrical piston wall is guided by several rollers with relatively smaller diameters that are distributed over the periphery thereof. This construction is expensive from a production point of view.

It is accordingly an object of the invention to provide a rotating piston compressor, which overcomes the hereinafore-mentioned disadvantages of the heretofore-known devices of this general type, which provides a less expensive type of support bracing, which should additionally be as free of wear as possible and which permits radial deformations or so-called ovalizations of the piston, in order to obtain a high degree of internal tightness between the cylinder and the piston, due to the contact pressure generated in the process.

With the foregoing and other objects in view there is provided, in accordance with the invention, a rotating piston compressor, comprising a cylinder having a first given diameter, a thin-walled, radially-resilient piston with a circular cross section and a second given diameter being disposed in the cylinder, a radial support for the piston in the form of a rotation-symmetrical thin-walled shell formed of permanently elastic material having one end connected to the piston and another end, a body with a circular periphery holding the other end of the shell, and a drive shaft connected to the body for moving the piston with an eccentricity being larger than one half of the difference between the first and second given diameters.

The invention provides a mounting which is resilient in the radial direction and is a so-called elastic foundation or support, which permits an overall large force transmission, in spite of its local resiliency. As compared to the conventional devices, the number of required antifriction bearings can be reduced very considerably. In addition, the advantage of a uniform distribution of the radial force transmission from the pressure shell to the rotating piston is obtained.

The body which is circular on the outside assures the desired "normal shape" of the shell for the contact pressure.

In accordance with an additional feature of the invention, the body is a shoulder of the shell extending radially inwardly.

This provides a one-piece component. However, the use of several parts is advantageous from a production point of view and these can be connected to each other.

In accordance with an added feature of the invention, the shell is a hollow straight cylinder or cone with an aperture angle of less than 20°.

This is done because such shapes are simple to manufacture. However, other shapes which meet particular requirements are also conceivable. For instance, the shell can also have a U-shaped cross section in order to permit the transmission of a transverse force to an antifriction bearing, without a bending moment.

In accordance with a further feature of the invention, there is provided a ring with lubricating properties connecting the shell to the piston. This permits a spacing between the piston and the shell to be adjusted, which in turn permits independent deformation over wide ranges. At the same time, the lubricating property of the ring reduces wear at the point of force transmission from the shell to the piston. The ring with lubricating properties can be a plastic ring, a ring formed of carbon or graphite or a sintered-metal ring.

In accordance with again another feature of the invention, the the one end of the shell is a free end, and the ring extends beyond the free end of the shell. In this way, the ring runs along the end surface of the cylinder as a sealing edge.

In accordance with again an added feature of the invention, at least one of the piston and the shell have a raised portion formed thereon in which the ring is fastened.

In accordance with again an additional feature of the invention, the piston has an end surface and the ring includes mutually resiliently movable inner and outer parts, as seen in axial direction, the outer part resting as a piston ring against the end surface of the cylinder and sealing the end surface.

This is done in order to obtain a certain amount of pressure with which the outer part rests against the end surface of the cylinder.

In accordance with again a further feature of the invention, the one end of the shell is a free end and including another shell with a free end pointing in opposite direction relative to the free end of the first-mentioned shell, the free ends being combined into a common shoulder.

This structure has the advantage of providing a symmetrical force introduction, through which undesired bending moments can be avoided.

In accordance with still another feature of the invention, the piston has a given axial length, and the free ends are located at approximately one fifth and four-fifths of the way along the given axial length of the piston.

In accordance with still an added feature of the invention, there is provided an eccentric sleeve rotatably disposed between the shoulder and the drive shaft.

In this way, the eccentricity can be adjusted accurately, so that the manufacturing tolerances can be wide. It is further possible in this way to compensate for wear which could occur during extended periods of operation.

In accordance with still an additional feature of the invention, the shell has recesses formed therein.

This permits the flow of cooling air to the inside of the piston.

In accordance with still a further feature of the invention, the recesses are round or preferably circular and have a net width which is at most one tenth of the diameter of the shell.

This is done so as not to adversely affect the desired uniform elasticity.

In accordance with yet an added feature of the invention, the body is a wheel body with a wear protection layer on the periphery thereof.

In accordance with a concomitant feature of the invention, the shell is reinforced in the vicinity of the body.

Other features which are considered as characteristic for the invention are set forth in the appended claims.

Although the invention is illustrated and described herein as embodied in a rotating piston compressor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
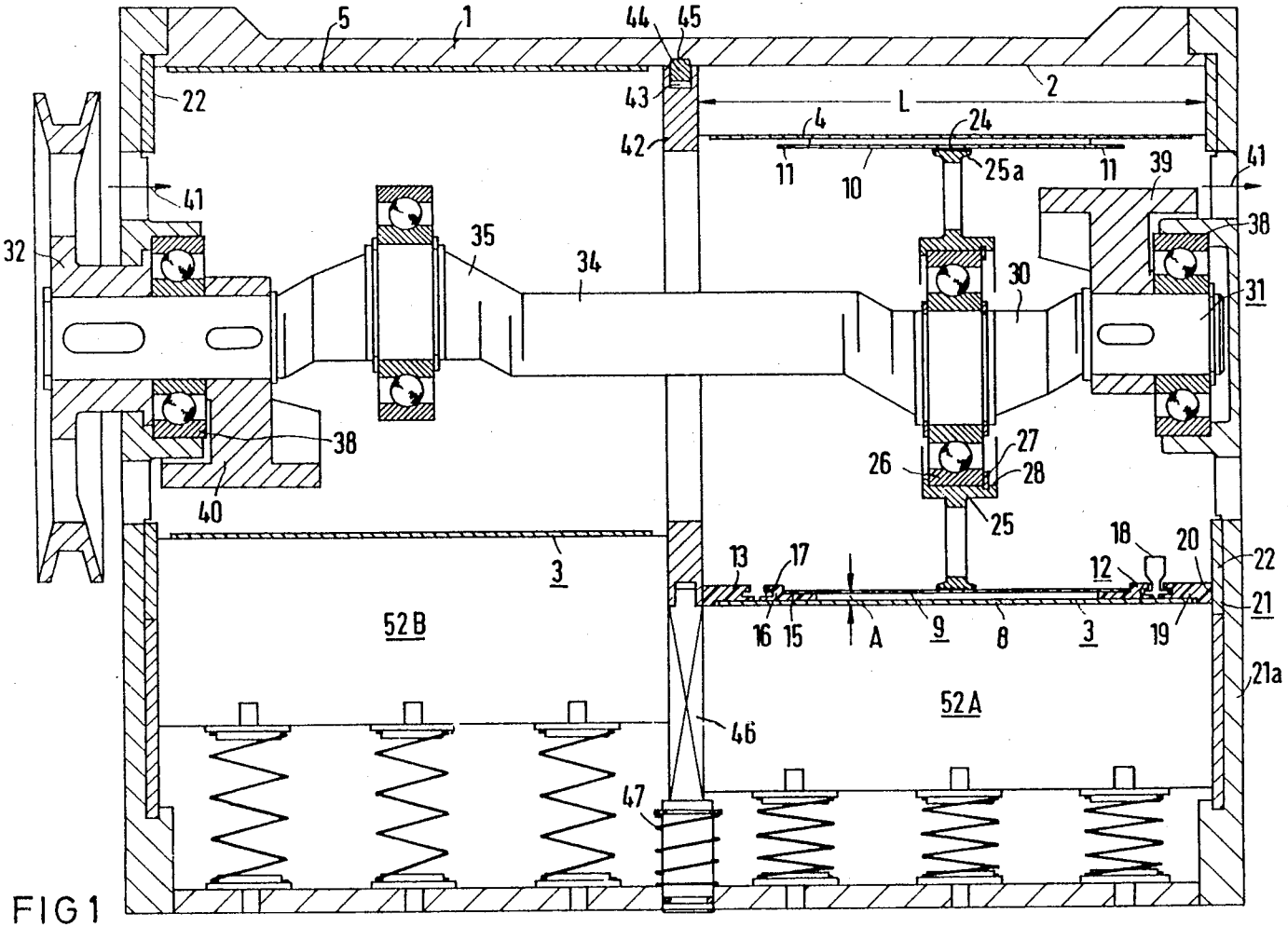
FIG. 1 is a diagrammatic, cross-sectional view of a rotating piston compressor in tandem construction along a drive shaft.

Referring now to the figures of the drawings in detail and first, particularly, to FIG. 1 thereof, there is seen a rotating piston compressor for charging motor vehicle engines, particularly diesel engines. The compressor includes an aluminum housing 1, which forms a cylinder 2 for a rotating piston 3 with two mutually shifted piston parts 4 and 5 at separating slider parts 52A and 52B. The piston parts 4 and 5 are identical. The cylinder 2 has an inside diameter of 166 mm.

Each piston parts 4, 5 includes a cylindrical tube 8 formed of cold-worked stainless steel with a wall thickness of 1.2 mm and a diameter of 145 mm. A support in the form of a rotation-symmetrical, thin-walled shell 9, is mounted inside the tube 8 as a cylindrical tube section 10 formed of the same material with a wall thickness of 0.3 mm. The diameter of the tube section 10 is smaller than that of the tube 8 by a distance A. The distance A is, for instance, 2 mm. The distance A is adjusted by two-piece symmetrical plastic rings 12 and 13 which are mounted at the ends 11 of the shell 9. The free ends 11, which transmit support force to the piston parts 4, 5, are symmetrical to the piston parts at approximately 20% and 80% of the way along the length L thereof.

The rings 12, 13 are formed of fiber-reinforced plastic. The cross section of the rings seen in FIG. 1 forms a spacer 15 which lies directly between the shell 9 and the tube 8 as well as a slotted region 16 having a slot 17 into which a metallic spring clamp 18 is inserted. The spring clamp 18 exerts an axial spring pressure on an extension 19 extending beyond the tube 8. The extension acts as a piston ring which rests with a sealing surface 20 against an end surface 21 of the cylinder 2. An aluminum end surface **21*a* of the housing 1 is armored with wear resistant steel rings 22**.

A wheel body 25 is disposed in the middle of the tube section 10 which forms an end 24 of the shell facing away from the free ends 11. The wheel body 25 is circular on the outside and may be formed, for instance, of aluminum. The wheel body 25 can be cemented to the shell 9 in order to obtain a joint which is strong in the axial direction. However, it can also simply rest against the inside of the shell 9 without play or with little play, forming a sliding fit. The outer periphery of the wheel body 25 may be provided with a hard or soft wear protection layer or it may have an annular, wear resistant intermediate ring **25*a* of coated steel or fiber-reinforced plastic. The shell 9** can also be reinforced locally at the point of force transmission, such as to a wall thickness of 2 mm.

An encapsulated ball bearing 26 is fastened in a recess 28 of the wheel body 25, with a snap ring 27. The ball bearing 26 is mounted on an offset part 30 of a steel drive shaft 31 which carries a V-belt pulley 32 outside the housing 1. The drive shaft 31 includes a central, straight shaft section 34, which connects the offset or cranked shaft part 30 to a shaft part 35 which is symmetrical to the part 30 and is offset oppositely, relative to the part 30,i.e. shifted by 180°, but is otherwise identical thereto. The eccentricity is 10 mm. A wheel body which is identical to the wheel body 25 is mounted on the part 35 and supports another non-illustrated shell 9 in the form of a tube section 10 as a support for the rotating piston part 5.

FIG. 1 shows that the drive shaft 31 is supported at both of its ends by ball bearings 38 in the end surfaces **2*la* of the housing 1. Two counterbalance weights 39 and 40 are fastened on the drive shaft 31 directly adjacent the ball bearings 38, for compensating mass moments produced by the different transverse forces at the drive shaft 31. The counterbalance weights 39, 40 have bevelled end surfaces in order to produce a propeller effect, by means of which a flow of cooling air is conducted through the cylinder 2 and the interior of the piston parts 4, 5 in the direction of arrows 41. Due to recesses in the shells 9, this cooling air flow can be conducted directly to the inside of the piston 8**, so that the compressor heat is removed inwardly as well as outwardly and in this manner, an approximation of the compression polytrope to an isotherm is obtained. This saves considerable mechanical drive power for the compressor.

A partition 42 is inserted into the cylinder 2 between the two rotating piston parts 4 and 5. The partition 42 is formed of steel. The periphery of the partition 42 has a slot 43 with walls having parallel edges between which a snap ring 44 is inserted. The snap ring 44 is engaged in a slot 45 in the surface of the cylinder 2. This structure has the advantage of permitting the cylinder 2 be machined in one operation for the two halves associated with the piston parts 4 and 5, before the partition 42 is inserted. The snap ring 44 is secured by a flattened rod 46 which is pushed into a recess from one side under the action of a spring 47.

Figure 2:
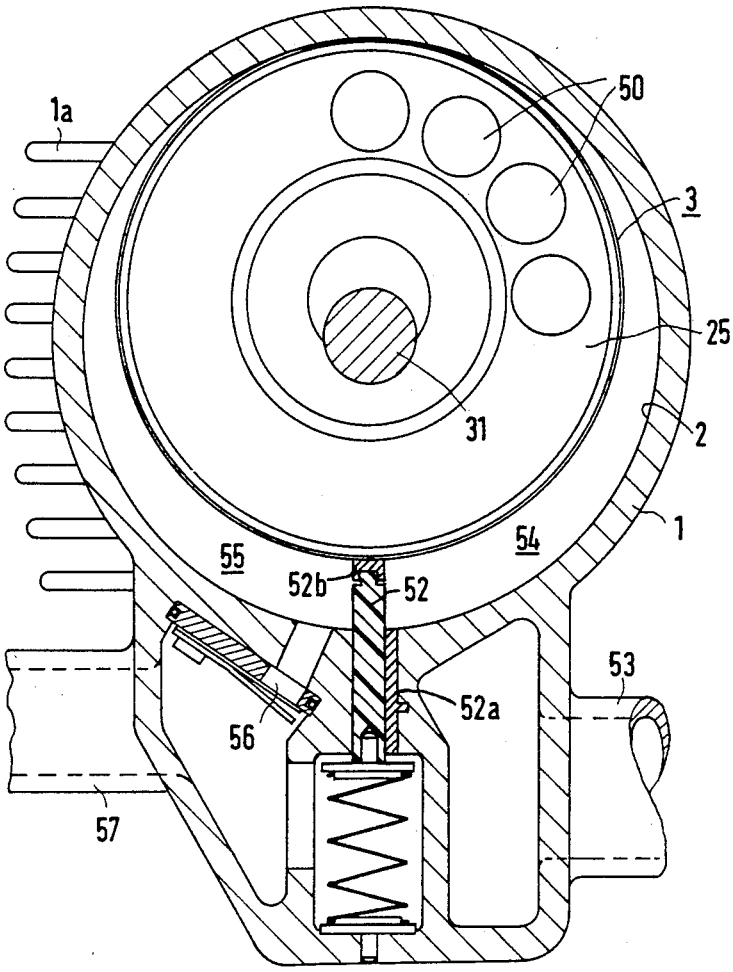
FIG. 2 is a fragmentary, cross-sectional view of the device shown in FIG. 1.

It can be seen from FIG. 2 that the wheel body 25 is provided with recesses 50 which permit the flow of coolant, save weight and simultaneously reduce the masses which have to be put in motion upon starting. FIG. 2 also shows a separating slider 52 which is guided in the housing 1 and separates a suction space 54 connected to a suction stub 53 from a pressure space 55 which is connected through a group of vane valves 56 to a pressure stub 57 of the rotating piston compressor. Cooling fins **1*a* improve the heat removal from the housing 1, particularly in the vicinity of the pressure space 55**.

In order to reduce the wear of the separating slider 52 which is formed of plastic, against the aluminum housing 1, a steel strip 52*a* is inserted and extends lengthwise over the entire housing 1. A rotatably movable sliding shoe 52*b* can be slipped on to help reduce the wear of the separating slider 52 at the rotating pistion parts 4, 5.

Figure 3:
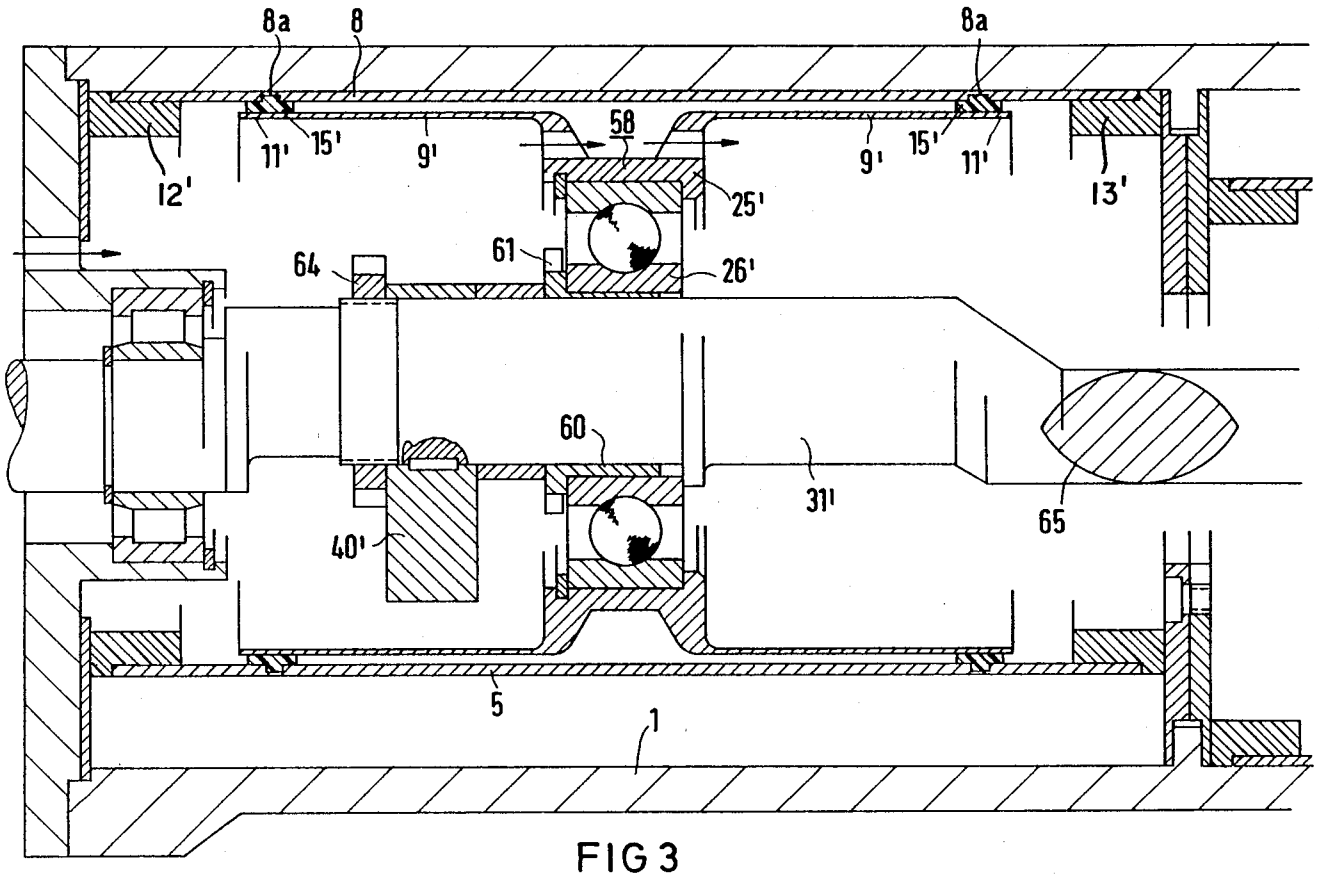
FIG. 3 is a fragmentary, cross-sectional view of a modified embodiment of the device along the drive shaft.

In the embodiment according to FIG. 3, two shells 9' with oppositely pointing free ends 11' are combined in a symmetrical component 58, which is constructed in one piece with a shoulder 25' extending radially inward, for instance as a turned part. At the shoulder 26, a ball bearing 26' is fastened along with an eccentric sleeve 60 to a drive shaft 31' which can be adjusted by a flange 61. The eccentric sleeve 60 has an additional eccentricity of ±1 mm, which permits an exact adjustment of the support of the rotating piston 3, which can also compensate conceivable wear. A counterweight 40' which can be clamped by a nut 64, is in communication with the eccentric sleeve 60. The drive shaft 31' has a lenticular or football-shaped cross section as is indicated at reference numeral 65. Plastic intermediate rings 15' are snapped into a slot 8*a* in the tube 8 which is machined from the inside. The rings are encapsulated there by the shells 9', so that they are axially secured. Rings 12' and 13' are mounted at the ends of the tube 8.

Figure 4:
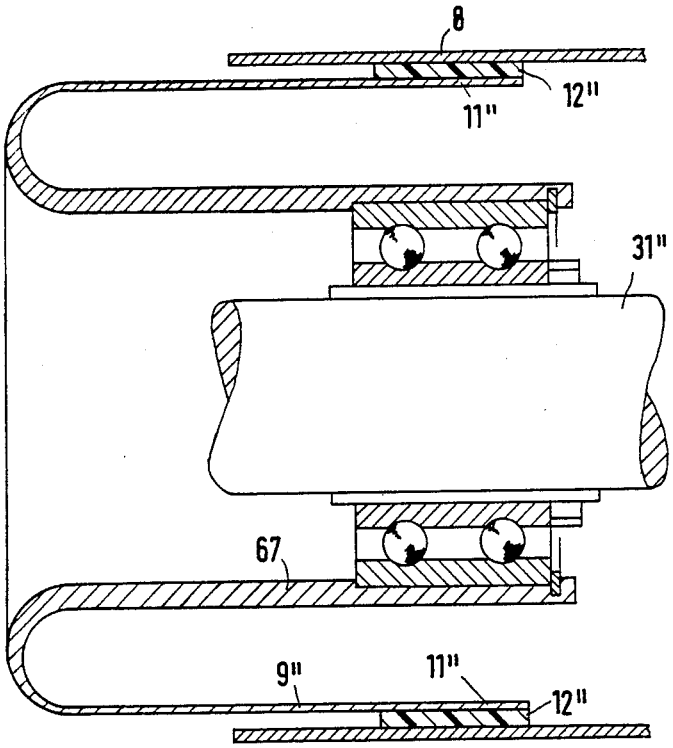
FIG. 4 is a fragmentary, cross-sectional view of a further embodiment of the device along the drive shaft.

According to the embodiment shown in FIG. 4, a shell body 9'' has a U-shaped cross section. A free end 11'' of the shell body 9'', provided with a ring 12'' therefore lies in the same radial plane as another end 67 which is enlarged to form a shoulder and is fastened on a drive shaft 31'' by a double roller bearing.

Figure 5:
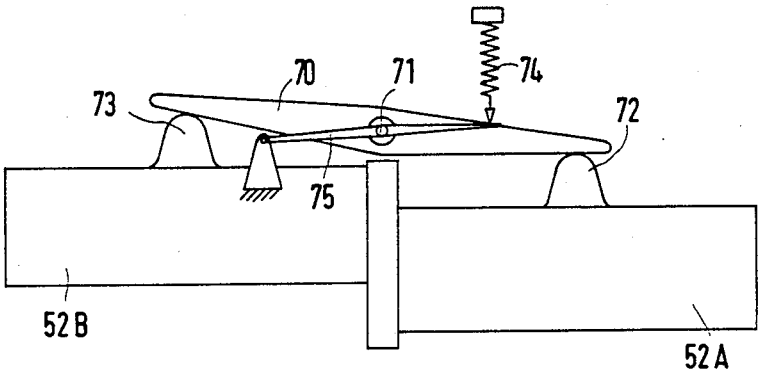
FIG. 5 is a front-elevational view showing details of a device for the control of the rotating piston compressor.

FIG. 5 shows that two separating slider parts 52A and 52B of a rotating piston compressor with a tandem construction can be controlled by an inherently resilient rocker 70 which is supported and centered in a rocker bearing 71 and acts on bumps 72 and 73 formed on the two separating slider parts 52A, 52B. The rocker 70 can additionally be loaded by a spring. It is furthermore possible to provide an adjusting device 74 in the form of a readjusting screw, through which the rocker bearing 71 which is provided on a one-armed lever 75, can be readjusted in the direction toward the separating slider parts 52A and 52B.

Figure 6:
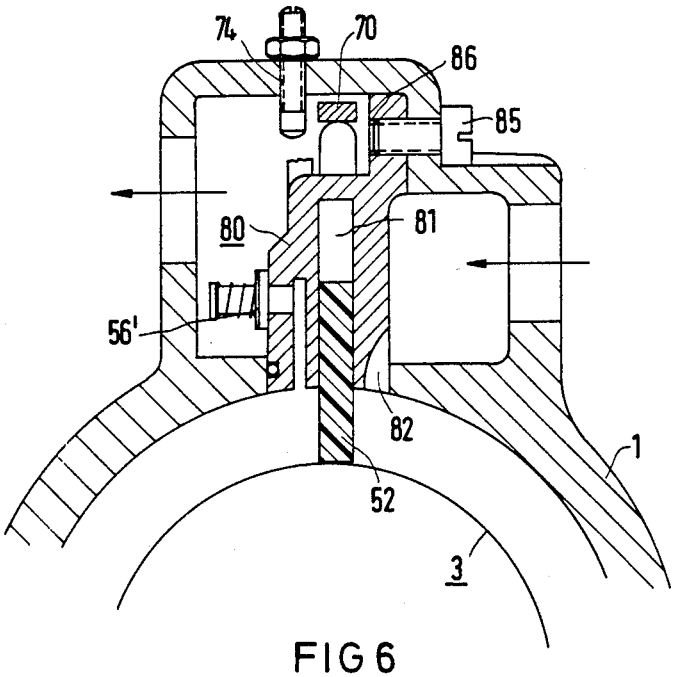
FIG. 6 is a fragmentary, cross-sectional view of an insert for the control of the rotating piston compressor according to the invention.

It is shown in FIG. 6 that an insert 80 which is formed of stainless steel is provided in the housing 1 of the aluminum rotating piston compressor. To begin with, the insert 80 has a slot 81 which forms a guide for the separating slider 52. A suction canal is also provided by another slot 82. Finally, a check yalve 56' which can also have several passage cross sections with separate valve members, is provided on the opposite side of the insert 80. The insert 80 is secured by a screw 85 which engages a tapped hole 86. The screw 85 can also serve for securing the rocker 70 which is brought to a suitable distance from the separating slider 52 by the adjusting device 74.

According to a non-illustrated embodiment, it is possible to slightly conically flare out the shell 9 on both sides in the form of a trumpet (aperture angle 3° toward the middle of the shell), for instance, from the outside diameter of 138 to 142 mm, in order to equalize the diameter of the ends 11 with the inside diameter of the piston 3 (142 mm). In this case, the plastic intermediate rings 12, 13 is omitted. Instead, a wear-resistant armor, such as an explosive coating with chromium carbide in a Cr-Ni matrix, is recommended.

I claim:

1. Rotating piston compressor, comprising a cylinder having a first given diameter, a slider part disposed in said cylinder, said cylinder having a suction port and a discharge port disposed at opposite sides of said slider part, a thin-walled, radially-resilient piston with a circular cross section and a second given diameter when unstressed being disposed in said cylinder, a radial support for said piston in the form of a rotation-symmetrical thin-walled shell formed of permanently elastic material having one end connected to said piston and another end, a body with a circular periphery holding said other end of said shell, and a drive shaft connected to said body for moving said piston with an eccentricity being larger than one half of the difference between said first and second given diameters, forming means for ovalizing said piston and said shell producing contact pressure between said cylinder and said piston leading to increased tightness.

2. Rotating piston compressor according to claim 1, wherein said body is a shoulder of said shell extending radially inwardly.

3. Rotating piston compressor according to claim 2, including an eccentric sleeve rotatably disposed between said shoulder and said drive shaft.

4. Rotating piston compressor according to claim 1, wherein said shell is a hollow straight cylinder.

5. Rotating piston compressor according to claim 1, including a ring with lubricating properties connecting said shell to said piston.

6. Rotating piston compressor according to claim 5, wherein said one end of said shell is a free end, and said ring extends beyond said free end of said shell.

7. Rotating piston compressor according to claim 5, wherein at least one of said piston and said shell have a depression formed therein in which said ring is fastened.

8. Rotating piston compressor according to claim 5, wherein said piston has an end surface and said ring includes mutually resiliently movable inner and outer parts, as seen in axial direction, said outer part resting as a piston ring against said end surface of said cylinder and sealing said end surface.

9. Rotating piston compressor according to claim 1, wherein said one end of said shell is a free end and including another shell with a free end pointing in opposite direction relative to said free end of said first-mentioned shell, said free ends being combined into a common shoulder.

10. Rotating piston compressor according to claim 9, wherein said piston has a given axial length, and said free ends are located at approximately one fifth and four-fifths of the way along said given axial length of said piston.

11. Rotating piston compressor according to claim 1, wherein said body is a wheel body with a wear protection layer on said periphery thereof.

12. Rotating piston compressor according to claim 1, wherein said shell is reinforced in the vicinity of said body.

* * * * *